US010131484B2

(12) United States Patent
De Cleir

(10) Patent No.: US 10,131,484 B2
(45) Date of Patent: Nov. 20, 2018

(54) CONTAINERS AND METHODS FOR ISOLATING LIQUIDS PRIOR TO DISPENSING

(71) Applicant: Kraft Foods Group Brands LLC, Chicago, IL (US)

(72) Inventor: Piaras Valdis De Cleir, Marietta, GA (US)

(73) Assignee: Kraft Foods Group Brands LLC, Chicago, IL (US)

( * ) Notice: Subject to any disclaimer, the term of this patent is extended or adjusted under 35 U.S.C. 154(b) by 3 days.

(21) Appl. No.: 15/795,158

(22) Filed: Oct. 26, 2017

(65) Prior Publication Data

US 2018/0044093 A1 Feb. 15, 2018

Related U.S. Application Data

(63) Continuation of application No. 14/655,692, filed as application No. PCT/US2013/073509 on Dec. 6, 2013, now Pat. No. 9,834,363.

(Continued)

(51) Int. Cl.

*B65D 1/04* (2006.01)
*B65D 81/32* (2006.01)

(Continued)

(52) U.S. Cl.

CPC ..... *B65D 81/3288* (2013.01); *B65D 1/04* (2013.01); *B65D 35/22* (2013.01);

(Continued)

(58) Field of Classification Search

CPC ..... B65D 81/3288; B65D 47/2018; B65D 47/2031; B65D 35/22; B65D 1/04;

(Continued)

(56) References Cited

U.S. PATENT DOCUMENTS 3,269,389 A 8/1966 Meurer et al.
3,581,940 A 6/1971 Cella (Continued)

FOREIGN PATENT DOCUMENTS

CN 1422226 6/2003
CN 101746567 6/2010

(Continued)

OTHER PUBLICATIONS

English translation of Notice on the Second Office Action, dated Aug. 1, 2017 for Chinese Patent Application No. 201380057420.7 (17 pgs.).

(Continued)

*Primary Examiner* — Patrick M Buechner
*Assistant Examiner* — Robert Nichols, II
(74) *Attorney, Agent, or Firm* — Fitch, Even, Tabin & Flannery LLP

(57) ABSTRACT

A container (100) for isolating first and second fluids, such as beverage concentrate components, until dispensing is provided, as well as methods of assembly and dispensing. The container can have first (111) and second (113) enclosed bodies for containing the first and second fluids to be dispensed and an insert (130) directing fluid from the enclosed bodies, such as toward one or more valves or separate discharge paths (148*a*, 148*b*).

13 Claims, 10 Drawing Sheets

Related U.S. Application Data

(60) Provisional application No. 61/746,791, filed on Dec. 28, 2012.

(51) Int. Cl.

| | |
|---|---|
| ***B65D 47/20*** | (2006.01) |
| ***B65D 47/24*** | (2006.01) |
| ***B65D 35/22*** | (2006.01) |
| *B65D 47/08* | (2006.01) |

(52) U.S. Cl.
CPC ..... *B65D 47/2018* (2013.01); *B65D 47/2031* (2013.01); *B65D 47/24* (2013.01); *B65D 81/3283* (2013.01); *B65D 47/0809* (2013.01)

(58) Field of Classification Search
CPC ..... B65D 81/3283; B65D 47/24; B65D 47/0809; A45D 2019/025
USPC ..... 222/94, 145.5, 129, 145.3
See application file for complete search history.

(56) References Cited

U.S. PATENT DOCUMENTS

| | | | | |
|---|---|---|---|---|
| 5,137,178 | A | 8/1992 | Stokes | |
| 5,318,203 | A | 6/1994 | Iaia | |
| 6,161,729 | A * | 12/2000 | Gentile | B65D 47/2031 222/129 |
| 6,308,862 | B1 * | 10/2001 | Fillmore | B05B 11/0043 222/105 |
| 6,398,077 | B1 | 6/2002 | Gross | |
| 6,439,433 | B1 * | 8/2002 | Dubach | B65D 47/06 222/145.3 |
| RE38,328 | E | 11/2003 | Gueret | |
| 6,685,041 | B1 | 2/2004 | Geisinger | |
| 8,052,016 | B2 | 11/2011 | Wang | |
| 8,365,958 | B2 * | 2/2013 | Ho | B01F 5/0615 222/137 |
| 2003/0006247 | A1 | 1/2003 | Olivier | |
| 2004/0206775 | A1 | 10/2004 | Holmes | |
| 2005/0103801 | A1 | 5/2005 | Felten | |
| 2006/0021996 | A1 * | 2/2006 | Scott, III | A47G 19/2266 222/145.5 |
| 2009/0277912 | A1 | 11/2009 | Wang | |
| 2013/0270294 | A1 | 10/2013 | Shibata | |

FOREIGN PATENT DOCUMENTS

| | | |
|---|---|---|
| CN | 201592840 | 9/2010 |
| CN | 201980581 | 9/2011 |
| EP | 1010643 | 6/2000 |
| GB | 1103534 | 2/1968 |
| JP | 4613494 | 5/1971 |
| JP | 60188150 | 12/1985 |
| JP | 339400 | 8/1991 |
| JP | H04352667 | 12/1992 |
| JP | H0535759 | 2/1993 |
| JP | H09501640 | 2/1997 |
| JP | 2003522682 | 7/2003 |
| JP | 2005535527 | 11/2005 |
| WO | 9505998 | 3/1995 |
| WO | 0158771 | 8/2001 |
| WO | 2012031120 | 3/2012 |
| WO | 2012073361 | 6/2012 |

OTHER PUBLICATIONS

English translation of Notification of Reasons for Refusal, dated Sep. 5, 2017 for Japanese Patent Application No. JP2015-550421 (5 pgs.).
Extended European Search Report, dated Apr. 4, 2017, for European Patent Application No. 17158469.1 (10 pgs.).
First Examination Report dated Oct. 10, 2016 for New Zealand Application No. 706963 (2 pgs.).
Further Examination Report, dated Aug. 4, 2017 for New Zealand Application No. 727121 (4 pgs.).
International Preliminary Report on Patentability and Written Opinion of the International Searching Authority, dated Jun. 30, 2015 for International Application No. PCT/US2013/073509 (11 pgs.).
International Search Report, dated Jun. 5, 2014 for International Application No. PCT/US2013/073509 (5 pgs.).
Notice of Acceptance dated Jan. 18, 2017 for New Zealand Application No. 706963 (1 pg.).
Notice of Acceptance for Patent Application dated Jan. 12, 2017 for Australian Applcation No. 2013368335 (3 pgs.).
Notice of the First Office Action for Chinese Application No. 201380057420.7 (15 pgs.).
Office Action dated May 2, 2016 for European Application No. 13812343.5 (5 pgs.).
Patent Examination Report No. 1 dated Sep. 30, 2016 for Australian Applcation No. 2013368335 (3 pgs.).
English translation of the Notification of Reasons for Refusal, dated Feb. 27, 2018, for Japanese Patent Application No. 2016-240493 ( 4 pgs.).
English translation of the Office Action, dated Feb. 26, 2018, for Russian Patent Application No. 2015116691 (2 pgs.).
English translation of the Office Action, dated Nov. 1, 2017, for Russian Patent Application No. 2015116691 (2 pgs.).
Examination Report No. 1 for Stadard Patent Application, dated Jan. 30, 2018, for Australian Application No. 2017202105 (3 pgs.).

* cited by examiner

CONTAINERS AND METHODS FOR ISOLATING LIQUIDS PRIOR TO DISPENSING

CROSS REFERENCE TO RELATED APPLICATIONS

This application is a continuation of U.S. application Ser. No. 14/655,692, filed Jun. 25, 2015, which is a U.S. national phase application of International Application No. PCT/US2013/073509, filed Dec. 6, 2013, which claims benefit from U.S. provisional Application No. 61/746,791, filed Dec. 28, 2012, which are all hereby incorporated herein by reference in their entireties.

FIELD

Containers and methods for isolating liquids until dispensing are provided and, in particular, for isolating and dispensing different liquids forming at least part of a beverage.

BACKGROUND

Concentrated liquids can be used to decrease the size of packaging needed to supply a desired quantity of end result product. However, some concentrated liquids may have a shelf life that is less that desired due to certain components. For example, an acid, such as citric or malic acid, added to a liquid concentrate can decrease the shelf life of the liquid concentrate.

Various attempts have been made to separate different components from each other prior to dispensing. Some of those attempts involve providing a device with a smaller chamber having a wall that is punctured to disperse their contents into a larger chamber, such as described in U.S. Pat. No. 7,017,735. Other attempts are described in U.S. Patent Appl. Publ. Nos. 2008/0116221; 2009/0236303; 2008/0245683. One drawback of such devices is that the smaller chamber can undesirably impede dispensing of the combined components. Indeed, in some instances the smaller chamber is removed after it has been punctured. This can limit the functionality and convenience of the devices. Another drawback of such devices is that they are intended to mix all of the two liquids together at the time of first use. This can be disadvantageous when the mixed liquids are not intended to be consumed at the time of first use, but rather over time.

Yet another problem with concentrated liquids is that they can include concentrated amounts of dye so that after mixing, the resulting product has the desired coloring. These dyes can stain surfaces, such as clothes, skin, etc., if they come into contact with the surfaces. Due to this, a container storing a concentrated liquid is undesirable if it allows the liquid concentrate to drip or otherwise leak from the container in an uncontrolled manner. One form of container releases a stream of liquid out of an opening when squeezed by a user. When this type of container is utilized to store a concentrated liquid, at least two problems can occur. First, due to the staining problem discussed above, if the concentrated liquid is squeezed into a container having a second liquid therein, undesirable splashing can occur when the stream of concentrated liquid impacts the liquid in the container. This splashed material can then stain the surrounding surfaces, as well as the clothes and skin of a user.

Additionally, unlike squeeze containers storing more solid contents where the amount of material being dispensed can be visually assessed, such as a ketchup or salad dressing bottle, a squeeze container dispensing a liquid concentrate into another liquid can disadvantageously be hard for a user to assess how much concentrated liquid has been dispensed in order to achieve the desired end mixture. Yet another problem can occur as the level of concentrated liquid remaining in the container is reduced during repeated uses. In this situation, the amount of concentrated liquid dispensed using the same squeeze force can disadvantageously change significantly as the liquid concentrate level changes within the container.

SUMMARY

A first embodiment of a container is provided for isolating a first liquid and a second liquid prior to dispensing. The container includes a first enclosed body for containing the first liquid and a second enclosed body for containing the second liquid. The first enclosed body has a first body access opening and the second enclosed body has a second body access opening. The first and second body access openings are adjacent one another. The container also includes a common cap secured to the first and second bodies. The common cap has a first dispensing channel and a second dispensing channel each having an open end and an end with a dispensing aperture. The container also includes an insert positioned between the access openings of the first and second bodies and the common cap. The insert defines a first dispensing path having an upstream entrance in fluid communication with the first body access opening and a downstream exit in fluid communication with the first dispensing channel. The insert also defines a second dispensing path having an upstream entrance in fluid communication with the second body access opening and a downstream exit in fluid communication with the second dispensing channel. The upstream entrances are offset from the respective dispensing channels.

In one aspect, the common cap includes a lid having an open position and a closed position and being configured to cover each of the dispensing apertures when in the closed position. In another aspect, the common cap includes a top wall and a raised spout including two dispensing apertures extending from the top wall. In yet another aspect, the spout includes a wall separating the first and second dispensing channels. In still another aspect, the container includes a first deflector and a second deflector configured to redirect the first and second liquids flowing from the respective downstream exit in a direction toward one another and into the first and second dispensing channels, respectively.

In still another aspect, a method is provided for dispensing a first liquid and a second liquid from the container. The method includes decreasing an interior volume of the first enclosed body to cause at least some of the first liquid to exit the first enclosed body and be discharged in a first liquid jet through the dispensing aperture of the first dispensing channel. The method further includes substantially simultaneously decreasing an interior volume of the second enclosed body to cause at least some of the second liquid to exit the second enclosed body and be discharged in a second liquid jet through the dispensing aperture of the second dispensing channel.

A second embodiment of a container is provided for isolating a first liquid and a second liquid prior to dispensing. The container includes a first enclosed body for containing the first liquid and a second enclosed body for containing the second liquid. The first enclosed body has a first body access opening and the second enclosed body has a second body access opening. The first and second body access opening are adjacent one another. The container further includes a common cap secured to at least one of the first and second bodies. The common cap has a first dispensing opening and a second dispensing opening. The container further includes an insert positioned between the access openings of the first and second bodies and the common cap. The insert defines a first dispensing path having an upstream entrance in fluid communication with the first body access opening and a downstream exit in fluid communication with the first dispensing opening. The insert also defines a second dispensing path having an upstream entrance in fluid communication with the second body access opening and a downstream exit in fluid communication with the second dispensing opening. Each of the dispensing paths has a valve movable between a closed configuration restricting flow through the valve and an open configuration permitting flow through the valve in response to pressure within each of the respective enclosed bodies.

In one aspect, the container further includes first and second raised spouts extending through first and second openings in a top wall of the common cap. The first spout includes the first dispensing aperture and the second spout includes the second dispensing aperture. In another aspect, the first and second spouts are duck bill valves. In yet another aspect, the first enclosed body and the second enclosed body are a unitary, blow-molded or injection molded structure.

In still another aspect, a method is provided for dispensing a first liquid and a second liquid from the container. The method includes decreasing an interior volume of the first enclosed body to cause at least some of the first liquid to exit the first enclosed body and be discharged in a first liquid jet through the dispensing aperture of the first dispensing opening. The method further includes substantially simultaneously decreasing an interior volume of the second enclosed body to cause at least some of the second liquid to exit the second enclosed body and be discharged in a second liquid jet through the dispensing aperture of the second dispensing opening.

A third embodiment of a container is provided for isolating a first liquid and a second liquid prior to dispensing. The container includes a first enclosed body for containing the first liquid and a second enclosed body for containing the second liquid. The first enclosed body has a first body access opening and the second enclosed body has a second body access opening. The first and second body access opening are adjacent one another. The container further includes a common cap secured to at least one of the first and second bodies. The common cap has a dispensing aperture. The container further includes an insert positioned between the access openings of the first and second bodies and the common cap. The insert defines a dispensing path having an upstream entrance in fluid communication with the first and second body access openings and a downstream exit in fluid communication with the dispensing aperture. The container further includes a valve moveable from a closed position blocking flow from both the dispensing path and through the dispensing aperture and isolating the first and second liquids upstream of the valve to an open position permitting flow through both the dispensing path and the dispensing aperture to dispense the first and second liquids from the container.

In one aspect, the container includes a mixing chamber disposed upstream of the valve and downstream of the downstream exit of the insert when the valve is in the open position. In another aspect, the container further includes a gasket positioned between the access openings of the first and second bodies and the insert. In yet another aspect, the insert includes a valve seat configured to permit the valve to sit thereon. In still another aspect, the valve is a flexible diaphragm moveable from the closed position to the open position. In still another aspect, the flexible diaphragm includes one or more slits that form one more flaps in the flexible diaphragm.

In still another aspect, a method is provided for dispensing a first liquid and a second liquid from the container. The method includes decreasing an interior volume of the first enclosed body to cause at least some of the first liquid to exit the first enclosed body and be discharged through the dispensing aperture. The method further includes substantially simultaneously decreasing an interior volume of the second enclosed body to cause at least some of the second liquid to exit the second enclosed body and be discharged through the dispensing aperture.

In one form, a container for isolating a first liquid and a second liquid prior to dispensing includes a first enclosed body for containing the first liquid and having a first body access opening and a second enclosed body for containing the second liquid and having a second body access opening with the second body access opening being adjacent to the first body access opening. The container further includes a common cap including first and second arcuate flanges configured to couple the common cap to the first and second bodies, respectively, the common cap having a dispensing aperture. The container also includes an insert positioned between the access openings of the first and second bodies and the common cap. The insert includes a first dispensing opening and a first tubular member around the first dispensing opening, a second dispensing opening and a second tubular member around the second dispensing opening, a first pair of arcuate flanges positioned at least in part around the first tubular member and configured to couple the insert to the first enclosed body, and a second pair of arcuate flanges positioned at least in part around the second tubular member and configured to couple the insert to the second enclosed body. The first and second tubular members and the first and second dispensing openings of the insert defining first and second dispensing paths each have an upstream entrance in fluid communication with the first and second body access openings and a downstream exit in fluid communication with the dispensing aperture. The container further includes a valve moveable from a closed position blocking flow from both the first and second dispensing paths and through the dispensing aperture and isolating the first and second liquids upstream of the valve to an open position permitting flow through both the first and second dispensing paths and the dispensing aperture to dispense the first and second liquids from the container.

Each of the first and second pairs of flanges of the insert can be shorter than each of the first and second arcuate flanges of the common cap.

In one form, a container for isolating a first liquid and a second liquid prior to dispensing includes a first enclosed body for containing the first liquid and having a first body access opening and a second enclosed body for containing the second liquid and having a second body access opening, with the second body access opening being adjacent to the first body access opening. The container further includes a common cap including first and second arcuate flanges configured to couple the common cap to the first and second bodies, respectively, the common cap having a dispensing aperture. The container also includes an insert positioned between the access openings of the first and second bodies and the common cap. The insert includes a first dispensing opening and a first tubular member around the first dispensing opening, a second dispensing opening and a second tubular member around the second dispensing opening, a first arcuate flange positioned at least in part around the first tubular member and opposite the first flange of the common cap and configured to couple the insert to the first enclosed body, and a second arcuate flange positioned at least in part around the second tubular member and opposite the second flange of the common cap and configured to couple the insert to the second enclosed body. The first and second tubular, members and the first and second dispensing openings of the insert defining first and second dispensing paths each have an upstream entrance in fluid communication with the first and second body access openings and a downstream exit in fluid communication with the dispensing aperture. The container also includes a valve moveable from a closed position blocking flow from both the first and second dispensing paths and through the dispensing aperture and isolating the first and second liquids upstream of the valve to an open position permitting flow through both the first and second dispensing paths and the dispensing aperture to dispense the first and second liquids from the container.

Each of the first and second arcuate flanges of the insert can be shorter than each of the first and second arcuate flanges of the common cap.

The insert can include an upwardly projecting valve seat surrounding the dispensing opening. A flexible valve member may be received in the valve seat.

The first and second tubular members can be positioned at least in part within the first and second body access openings, respectively.

The first and second tubular members can be in a friction fit with interior surfaces of the first and second body access openings, respectively.

The container can further include a sealing ring positioned around each one of the first and second tubular members.

Each of the first and second enclosed bodies can include a neck and a downwardly extending ramp surrounding the neck. Each of the first and second arcuate flanges of the common cap can include a distal portion with an inwardly extending ramp configured to couple to the ramp of a respective one of the first and second enclosed bodies.

The first and second enclosed bodies can be two separate containers.

DETAILED DESCRIPTION

Containers configured for isolating a first and second fluid prior to dispensing and then combining during dispensing are provided, as well as methods of assembly and dispensing. The container is suitable for multiple dispenses, and the fluids can be components of a beverage or beverage concentrate. Advantageously, the first and second fluids are kept separate prior to dispensing. Also advantageously, preferably only or substantially only the dispensed portions of the first and second fluids are mixed during dispensing. That is, not all of the first and second fluids are mixed during a given dispense cycle. The isolation of the dispensed portions of the first and second fluids until dispensing can restrict or prevent the ability of one of the fluids to interact with the other of the fluids. Avoiding such interaction can increase the shelf life of the filled container, such as when interaction of the fluids could decrease the shelf life. Such isolation can be achieved while still providing for a container that does not require complicated steps for dispensing.

Figure 1:
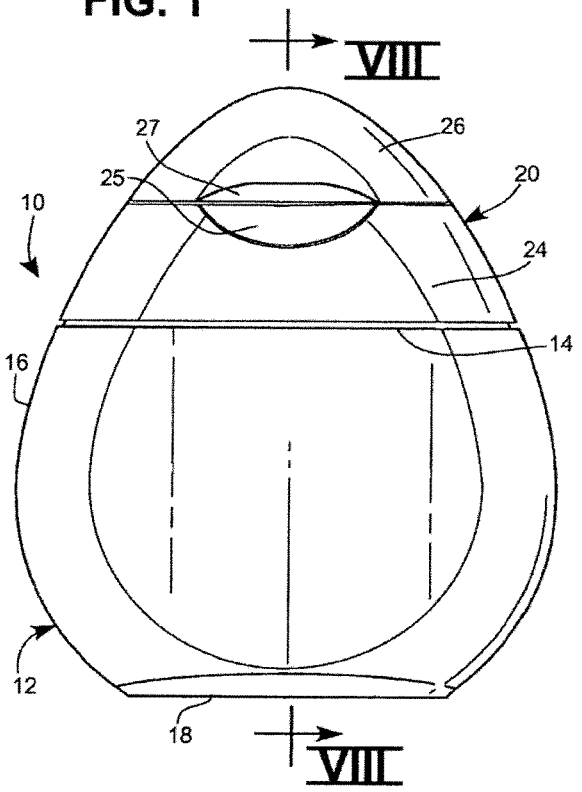
FIG. 1 is a front elevation view an exemplary container having two compartments for dispensing beverage concentrates of a first embodiment, showing a container body with a cap having a lid that is closed.
Figure 2:
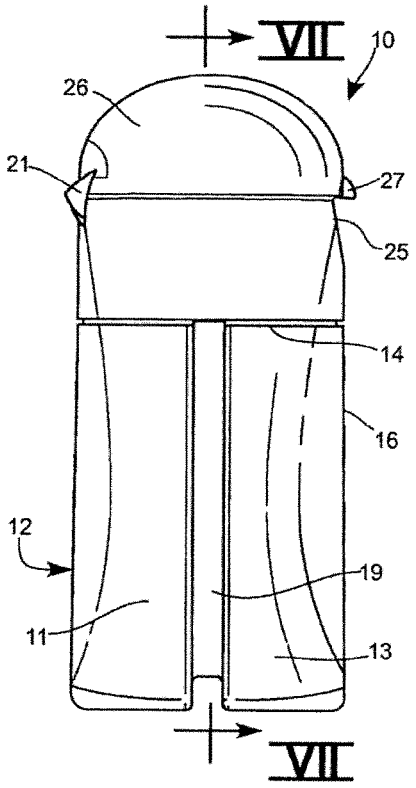
FIG. 2 is a side elevation view of the container of FIG. 1 with the lid of the cap being closed.
Figure 3:
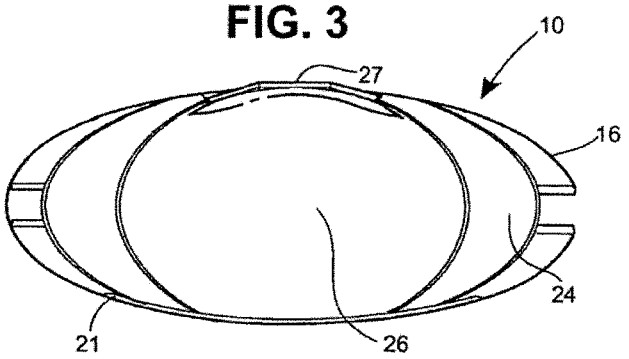
FIG. 3 is a top plan view of the container of FIG. 1 with the lid of the cap being closed.
Figure 4:
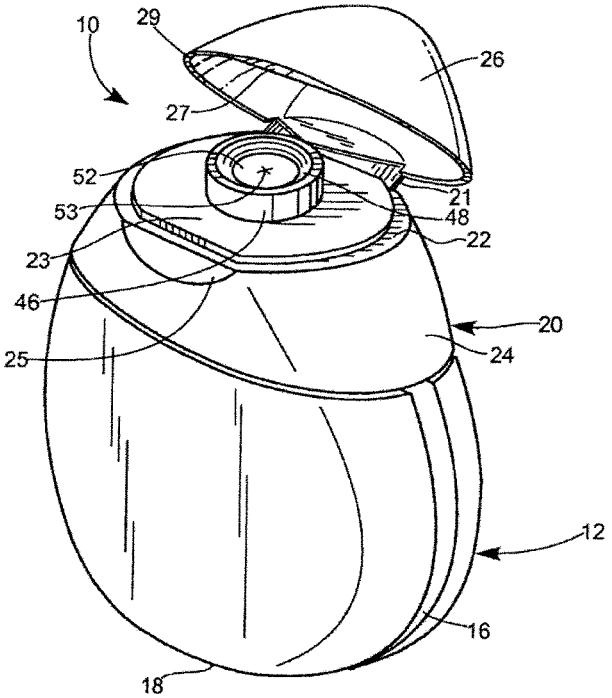
FIG. 4 is a perspective view of the container of FIG. 1 with the lid of the cap being open.
Figure 5:
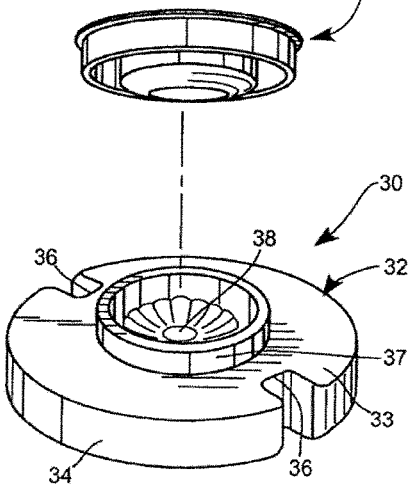
FIG. 5 is an exploded perspective view of an exemplary insert and an exemplary valve member useable with the container of FIG. 1.
Figure 6:
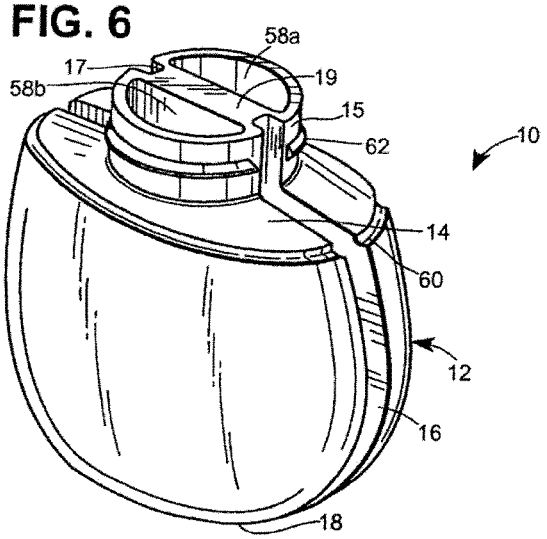
FIG. 6 is a perspective view of the container body of FIG. 1.
Figure 7:
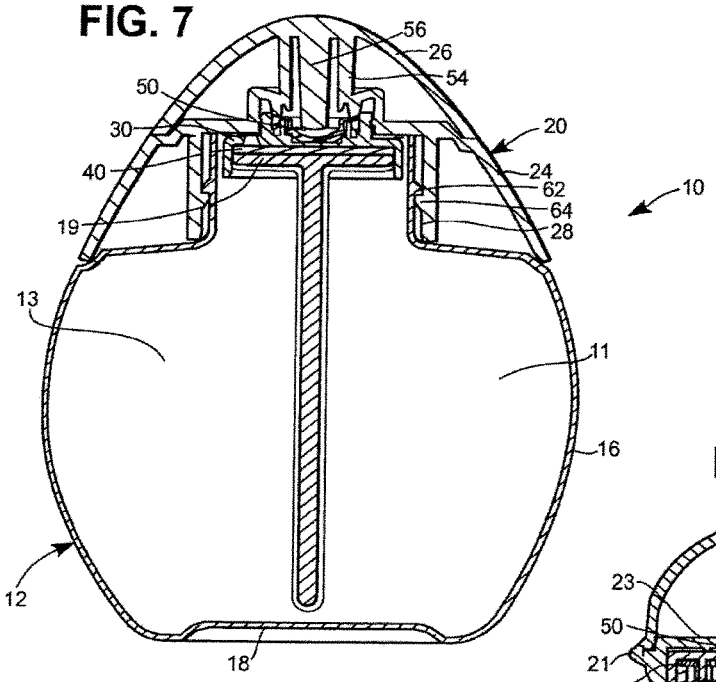
FIG. 7 is a cross-sectional view of the container of FIG. 1, taken along line VII-VII of FIG. 2 with the exemplary insert and valve members of FIG. 5 positioned between the container body and the cap.
Figure 8:
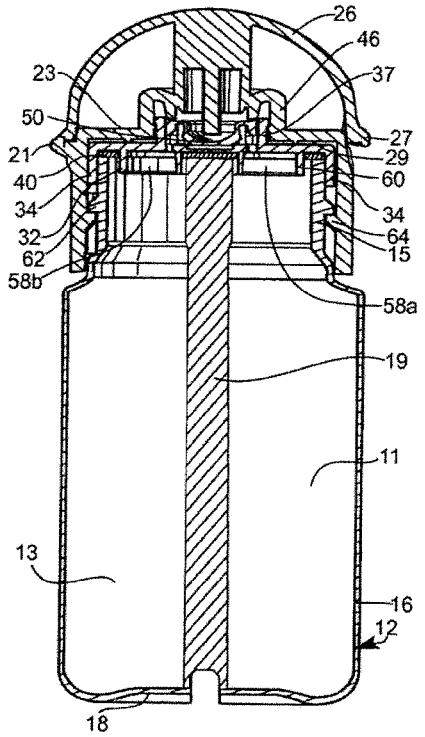
FIG. 8 is a view of the container of FIG. 1 taken along line VIII-VIII thereof.

With reference to the first exemplary embodiment of FIGS. 1-8, the container 10 includes a body 12 with a cap 20 attached to the top. Positioned beneath the underside of the cap 20 is an insert 30, as illustrated in FIGS. 5, 7, and 8. The body 12 of container 10 includes a first enclosed body 11 for storing a first fluid and a second enclosed body 13 for storing a second fluid. Initially, first and second fluids, and in the exemplary case, first and second beverage concentrate components, are maintained separately in isolation in the container 12. However, when it is desirable to dispense a portion (or all) of the concentrate components, pressure is applied to the outside of the container 10 and a valve member 50 of the insert 30 is moved from a closed position to an open position whereby the first and second beverage components can exit the body 12 and insert 30, respectively, together.

More specifically, each of the first and second beverage components has an associated and separate exit flow path upstream of the valve member 50 when the valve member 50 is in its closed position. When the valve member 50 moves to its open position, portions of the first and second beverage components can flow through their respective exit flow paths, mix upstream of the valve member 50 and then pass through the valve member 50 for dispensing, such as in a jet. The beverage concentrate can be dispensed into, for example, water or other liquid, to form a beverage. Exemplary beverage concentrates are disclosed in U.S. Pat. Appl. No. 61/320,155, filed Apr. 1, 2010, which is hereby incorporated by reference in its entirety. It will be appreciated that the volume ratio between the first and second beverage components in first and second enclosed bodies 11 and 13 can be between about 1:1 and 9:1, between about 1:1 and 4:1, or about 2:1. Suitable sizes of the container, further details of its construction, exemplary beverage concentrates and the numbers of doses therein are discussed in PCT/US2010/48449, filed Sep. 10, 2010, which is hereby incorporated by reference in its entirety.

Turning to details of the first container embodiment 10, and with reference to FIGS. 1-8, the body 12 is enclosed by a bottom wall 18, an opposite shoulder 14 at the top portion of the body 12 and a sidewall 16 extending between the shoulder 14 and the bottom wall 18. A neck 15 extends upward from the shoulder 14 opposite the bottom wall 18 and defines a first body access opening 58*a* that provides an entrance to and an exit from the first enclosed body 11 and a second body access opening 58*b* that provides an entrance to and an exit from the second enclosed body 13. The first enclosed body 11 can store the first liquid and the second enclosed body 13 can store the second liquid.

In the illustrated form, the neck 15 includes opposed indents 17 and a common wall 19, which maintains the first and second liquids separate from one another as the first and second liquids flow through the neck 15. In the illustrated form, the wall 19 extends through the neck 15 and from the base of the neck 15 to the bottom wall 18 of the body 12 to keep the first and second liquids separate along the entire height of the body 12. It is to be appreciated that wall 19 does not have to extend through the entire height of the neck 15, but could extend through just a portion of the height of the neck 15. It is also to be appreciated that the wall 19 can provide an additional support structure within the container body 12 such that the sidewall 16 can be less rigid yet the container body 12 can maintain its structural integrity when exposed to external forces during the attachment of the cap 20 or during the storage of the container 10. In the illustrated form, neck 15 and wall 19 provide structures for mounting of the cap 20 and for supporting some or all of the insert 30, as will be described in greater detail herein.

The cap 20 is attached to the neck 15 of the body 12 of the container 10. The cap 20 includes a top wall 23, as illustrated in FIG. 4, with a depending skirt about its periphery. A raised spout 46 defines an opening 48 extending through the top wall 23. In the illustrated form, the spout 46 is cylindrical, but it is to be appreciated that other suitable shapes may be used for the spout 46. A lid 26 of the cap 20, which is moveable between open and closed positions, is configured to cover the spout 46 when the lid is in the closed position. In the illustrated form, the lid 26 is pivotally connected to the remainder of the cap 20 by a hinge 21 and can pivot about the hinge 21 from the open position to the closed position. In one form, the lid 26 can be configured to snap fit with the remainder of the cap 20. In this form, a recessed portion 22 can be provided along the periphery of the top wall 23 of the cap 20. The recessed portion 22 is configured to receive the bottom surface 29 of lid 26 to form a snap fit. In this form, a recessed portion 25 can be also provided in the skirt 24 adjacent the lid 26 when the lid 26 is pivoted to a closed position. The recessed portion 25 can then facilitate access to a projecting ledge 27 of the lid 26 so that a user can manipulate the ledge 27 to open the lid 26. In the illustrated form, the lid 26 is generally dome-shaped, but the lid 26 can be of other suitable shapes.

With reference to FIGS. 4 and 5, received within the opening 48 of the spout 46 is the valve member 50. In the illustrated form, the valve member 50 acts as a diaphragm, and has a flexible membrane or plate portion 52 with a plurality of slits therein, and preferably two intersecting slits forming four generally triangular flaps, as illustrated in FIG. 4. So configured, when the container 10 is squeezed, such as by depressing opposing portions of the sidewall 16 toward each other, the first and second beverage components stored in first and second enclosed bodies 11 and 13, respectively, are forced against the membrane 52 which outwardly displaces the flaps to allow the components to both mix together upstream of the membrane 52 of valve member 50 to form a beverage concentrate and exit through a dispensing aperture 53 in the membrane 52 in a jet. In one aspect, the jet of the beverage concentrate emitted from the exemplary container 10 preferably combines velocity and mass flow to impact a target liquid (not shown) within a target container (not shown) to cause turbulence in the target liquid and create a generally uniform mixed end product (not shown) without the use the extraneous utensils or shaking.

The lid 26 may further include a stopper 54 projecting from an interior surface of the lid 26. Preferably, the stopper 54 is sized to snugly fit within the spout 46, as illustrated in FIGS. 7 and 8, to provide additional protection against unintended dispensing of the liquid beverage concentrate stored in first and second enclosed bodies 11 and 13 or other leakage. In the illustrated form, the stopper 54 can be a hollow, cylindrical projection. An optional inner plug 56 can be disposed within the stopper 54 and project further therefrom, and can contact the membrane 52 of the valve member 50 disposed in the opening 48 of the spout 46. More specifically, the inner plug 56 can restrict movement of the flaps of the membrane 52 of the valve member 50 from a concave orientation, whereby they are closed, to a convex orientation, whereby the flaps are at least partially open for dispensing.

The stopper 54 can be configured to cooperate with the spout 46 to provide one, two or more audible and/or tactile responses to a user during closing. For example, sliding movement of the rearward portion of the stopper 54 past the rearward portion of the spout 46—closer to the hinge 21—can result in an audible and tactile response as the lid 26 is moved toward a closed position. Further movement of the lid 26 toward its closed position can result in a second audible and tactile response as the forward portion of the stopper 54 slides past a forward portion of the spout 46—on an opposite side of the respective rearward portions from the hinge 21. Preferably the second audible and tactile response occurs just prior to the lid 26 being fully closed. This can provide audible and/or tactile feedback to the user that the lid 26 is closed.

The cap 20 has an outer, generally cylindrical flange 28 depending from the underside of the top wall 23 that is configured to engage the outer surface of the neck 15, as shown in FIGS. 7 and 8. The outer surface of the neck 15 includes, preferably adjacent its open upper end, a downwardly inclined circumferential ramp 62, as illustrated in FIGS. 6-8. The distal portion of the outer flange 28 of the cap 20 includes a circumferential, inwardly extending cap ramp 64, as shown in FIGS. 7 and 8. The ramp 64 of the cap 20 and the ramp 62 of the neck 15 are configured such that they can more readily be slid past each other when the cap 20 is pressed downwardly about the neck 15 as compared to when removal of the cap 20 from the neck 15 is attempted. In this manner, the cap 20 can be attached to and retained on the neck 15 and hence the body 12 of the container 10. The use of the term retain does not mean that it is impossible to move from a given position; rather that there is some force that must be overcome in order to do so. In order to attach the cap 20 to the neck 15, the cap ramp 64 slides along the ramp 62 of the neck 15, with the neck 15 and/or the outer flange 28 of the cap 20 flexing away from each other until the ledges formed adjacent the respective ramps 64 and 62 interlock to restrict outward removal of the cap 20.

With reference to FIGS. 5, 7, and 8, the exemplary insert 30 in the first embodiment comprises a hollow, cylindrical body portion 32 having two opposed indents 36. Body portion 32 has a top wall 33, an outer flange 34 depending downwardly from the top wall 33, and an upwardly projecting annular rim or valve seat 37 circumscribing an exit orifice 38, as depicted in FIG. 5. In the illustrated form, the insert 30 also includes an inner, generally cylindrical flange 60 depending from the underside of the top wall 33. The inner flange 60 is disposed inwardly from the outer flange 34, and extends downwardly a shorter distance from the top wall 33 of the insert 30 than cuter flange 34. The spacing between the inner and outer flanges 60 and 34 is selected so that the upstanding, generally cylindrical neck 15 of the body 12 of the container 10 is received therebetween, as shown in FIG. 8. This provides a more secure fit between container 12 and insert 30.

The insert 30 is configured to be inserted partially into the neck 15 of the body 12 of the container 10. In particular, when assembled, as depicted in FIGS. 7 and 8, the inner flange 60 of the insert 30 is disposed at least partially within the neck 15 of the container 10. After placement of the insert 30, the cap 20 can be attached to the neck 15 of the body 12 of the container 10.

When the insert 30 is inserted into the body 12 of the container 10 and the cap 20 is attached to the neck thereof and the container 10 is in a non-dispensing configuration, illustrated in FIG. 8, the valve member 50 is positioned to engage the projecting rim 37 of the insert 30. This engagement has several objectives. A first of the objectives is to block the first beverage component stored in the first enclosed body 11 from exiting the body 12 of the container 10. A second of the objectives is to also block the second beverage component stored in the second enclosed body 13 from exiting the body 12 of the container 10. A third of the objectives is to maintain isolation between the first and second beverage components stored in the first and second enclosed bodies 11 and 13.

With respect to the first and second of the objectives of the engagement between the projecting rim 37 of the insert 30 and the valve member 50, the valve member 50 is positioned to block the exit or dispensing path of the first and second beverage components stored within the first and second enclosed bodies 11 and 13 from the body 12 of the container 10. In the illustrated form, as shown in FIG. 8, the dispensing or exit path of the first and second beverage components extends from the first and second body access openings 58*a* and 58*b* through the exit orifice 38 of the projecting rim 37 and into a region bounded by the bottom of the spout 46, a portion of the valve member 50, and the projecting rim 37. The valve member 50 is movable between a closed position, shown in FIG. 4, blocking the dispensing path of the first and second beverage components, and an open position (not shown) permitting flow of the first and second beverage components through the exit path. When the valve member 50 is in its closed position, illustrated in FIG. 4, the slits of the membrane 52 of the valve member 50 are closed and block the dispensing path of the first and second beverage components. However, when the valve member 50 is moved to its open position, such as when the body 12 of the container 10 is squeezed, the valve member 50 shifts to its open position and the slits of the membrane 52 can open to permit the first and second beverage components to flow through the dispensing aperture 53 formed between the slits.

In the illustrated form, when the valve member 50 is in the open position (not shown), the membrane 52 of the valve member 50 moves away from the projecting rim 37 of the insert 30 such that a space or chamber (not shown) is formed therebetween for the first and second beverage components to flow through and then force the slits of membrane 52 of the valve member 50 to open and then exit past the dispensing aperture 53 between the slits.

With respect to the third of the objectives, isolation between the first and second beverage components is accomplished when the valve member 50 is in the closed position, as illustrated in FIGS. 7 and 8. When the valve member 50 is moved to its open position (not shown), such as when the body 12 of the container 10 is squeezed, the first and second beverage components are permitted to mix downstream of the first and second body access openings 58*a* and 58*b* and upstream of the valve member 50 before exiting through the dispensing aperture 53 between the open slits of the membrane 52 of the valve member 50.

Figure 9:
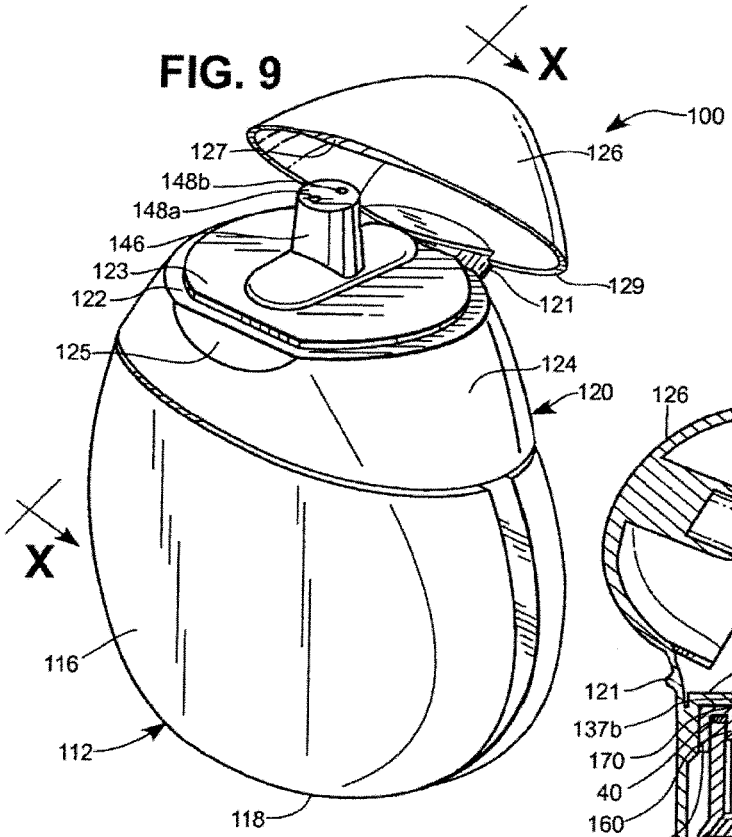
FIG. 9 is a perspective view of an exemplary container having two compartments for dispensing beverage concentrates of a second embodiment, showing the container body with a cap having a lid that is open.
Figure 10:
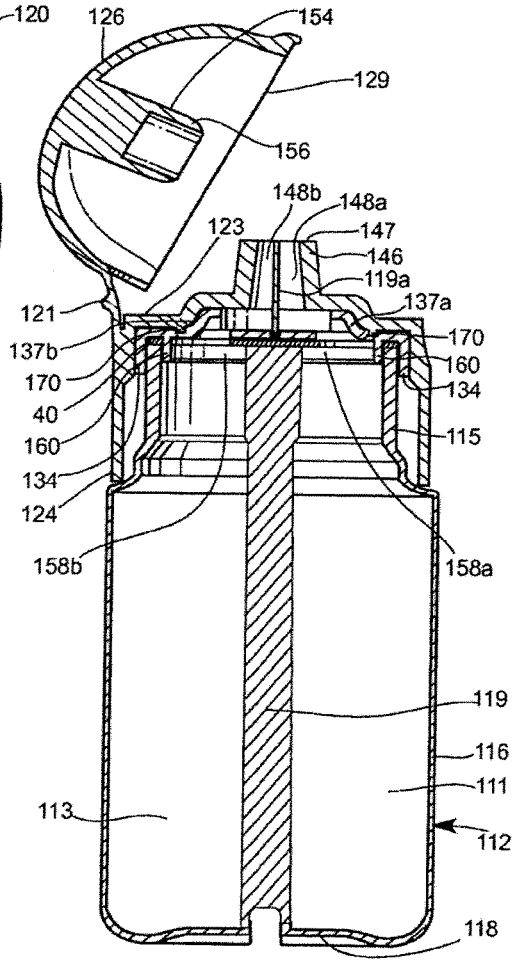
FIG. 10 is a cross-sectional view of the container of FIG. 9 taken along line X-X thereof.
Figure 11:
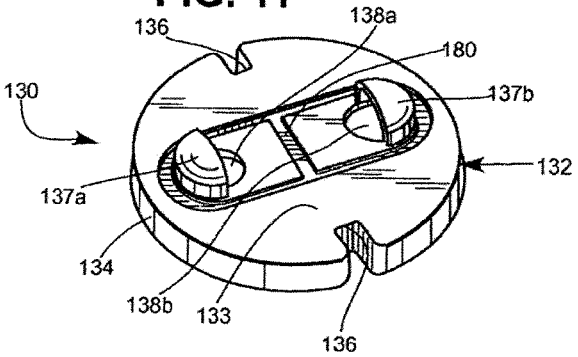
FIG. 11 is a perspective view of an exemplary insert useable with the container of FIG. 9.

With reference to FIGS. 9-11, the exemplary insert 130 in the second embodiment comprises a hollow, cylindrical body portion 132 having two opposed indents 136. The body portion 132 has a top wall 133, an outer flange 134 depending downwardly from the top wall or surface 133, and an inner, generally cylindrical flange 160 depending from the underside of the top wall 133. The inner flange 160 is disposed inwardly from the outer flange 134, and extends downwardly a shorter distance from the top wall 133 of the insert 130 than outer flange 134. The spacing between the inner and outer flanges 160 and 134 is selected so that the upstanding, generally cylindrical neck 115 of the body 112 of the container 100 is received therebetween, as shown in FIG. 10. This provides a more secure fit between container 112 and insert 130.

With reference to FIG. 11, the top wall 133 of the insert 130 includes first and second exit orifices or openings 138*a* and 138*b*. Deflectors 137*a* and 137*b* extend upward from the top wall 133. Deflectors 137*a* and 137*b* are positioned at least in part over the openings 138*a* and 138*b*, respectively, and are shaped to deflect the flow path of the first and second fluids as they are being dispensed through the insert 130 and first and second openings 138*a* and 138*b*. In the exemplary form, deflectors 137*a* and 137*b* are at least in part curved and generally oriented in a converging orientation to one another, as shown in FIGS. 10 and 11. The converging orientation redirects the first and second fluids that flow through the openings 138*a* and 138*b*, respectively, toward one another.

The insert 130 is configured to be inserted partially into the neck 115 of the body 112 of the container 100. In particular, when assembled, as depicted in FIG. 10, the inner flange 160 of the insert 130 is disposed at least partially within the neck 115 of the container 100. After placement of the insert 130, the cap 120 can be attached to the neck 115 of the body 112 of the container 100.

The cap 120 includes a top wall 123, as illustrated in FIGS. 9 and 10, with a depending skirt 124 about its periphery. A raised spout 146 defines dispensing apertures 148*a* and 148*b* extending through the top wall 123 of the cap 120, as shown in FIGS. 9 and 10. In the illustrated form, the spout 146 is cylindrical, but it is to be appreciated that other suitable shapes may be used for the spout 146. Received at least in part within the spout 146 is a common wall 119*a*, which maintains the first and second liquids separate from one another as the first and second liquids flow through the first and second dispensing channels of the spout 146. In the illustrated form, the wall 119*a* extends through the spout 146. With reference to FIG. 10, one or more ribs 170 project downwardly from the underside of the top wall 123. The top wall 133 of the insert 130 includes one or more grooves 180 sized and shaped to receive one or more of the ribs 170 and a portion of the common wall 119*a*, thereby providing a more secure fit and a tighter seal between the cap 120 and the insert 130.

In the illustrated form, as shown in FIG. 10, the maximum cross-sectional dimension of the container 112 is greater than the maximum cross-sectional dimension of the neck 115, which is greater than the maximum cross-sectional dimension of the spout 146. Accordingly, the wall 119 has a greater maximum cross-sectional dimension in the body 112 than it does in the neck 115. Similarly, the maximum cross-sectional dimension of the wall 119 in the neck 115 is greater than the maximum cross-sectional dimension of wall 119*a* in the spout 146. Further, as shown in FIG. 10, body access openings 158*a* and 158*b* have a greater maximum cross-sectional dimension than the maximum cross-sectional dimension of the dispensing apertures 148*a* and 148*b*, respectively. Further, in the illustrated form shown in FIG. 10, body access openings 158*a* and 158*b* are offset from the dispensing apertures 148*a* and 148*b*, respectively. In addition, FIG. 10 shows that the body access openings 158*a* and 158*b* each have a maximum cross-sectional area greater than the maximum cross-sectional area of each of the exit orifices 138*a* and 138*b*, and the central axes of the exit orifices 138*a* and 138*b* are closer together than the central axes of the body access openings 158*a* and 158*b*. At least for these reasons, the deflectors 137*a* and 137*b* are oriented to redirect the flow of the first and second liquids inwardly, i.e., toward the wall 119*a*, as shown in FIG. 10.

When the container 100 is squeezed, such as by depressing opposing portions of the sidewall 116 toward each other, the first and second beverage components stored in the first and second enclosed bodies 111 and 113 are forced out of the first and second body access openings 158*a* and 158*b*, respectively. Upon exit from the first and second body access openings 158*a* and 158*b*, the first and second liquids follow the first and second dispensing paths, respectively. In particular, the first and second liquids flow into the entrance and out of the exit of exit orifices 138*a* and 138*b* of the insert 130. Upon exiting from the exit orifices 138*a* and 138*b*, the first and second liquids come into contact with and are redirected by the deflectors 137*a* and 137*b* of the insert. In the illustrated form, as discussed above, and shown in FIGS. 10 and 11, the preferred shape and orientation of the deflectors 137*a* and 137*b* are such that the first and second fluids are redirected generally in the direction toward one another and toward the wall 119*a*. The first and second fluids then enter the spout 146 and flow through the first and second dispensing channels in the spout 146 while being separated by the wall 119*a* and exit from the dispensing apertures 148*a* and 148*b*, respectively, in jets. It is to be appreciated that the jets may be either parallel, converging, or diverging relative to one another.

In the illustrated form, the lid 126 may further include a stopper 154 projecting from an interior surface of the lid 126, as shown in FIG. 10. Preferably, the stopper 154 is sized to contact the spout 146 and cover the top surface 147 of the spout 146, including dispensing apertures 148*a* and 148*b*, to provide additional protection against unintended dispensing of the liquid beverage concentrate stored in first and second enclosed bodies 111 and 113 or other leakage. In the illustrated form, the stopper 154 can be a hollow, cylindrical projection. An optional inner plug 156 can be disposed within the stopper 154 and project further therefrom, and can contact the top surface 147 of the spout 146 and cover just the dispensing apertures 148*a* and 148*b* to prevent leakage therefrom.

Figure 13:
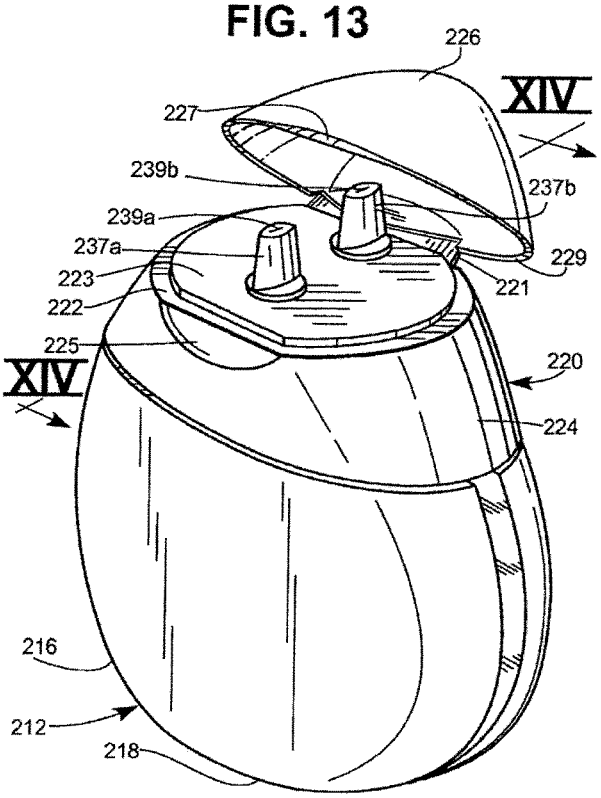
FIG. 13 is a perspective view of an exemplary container having two compartments for dispensing beverage concentrates of a third embodiment, showing a container body with a cap having a lid that is open.
Figure 14:
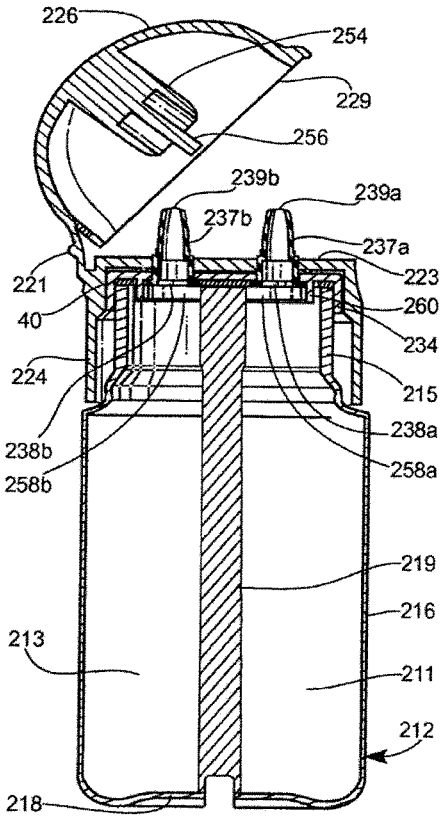
FIG. 14 is a cross-sectional view of the container of FIG. 13, taken along line XIV-XIV thereof.
Figure 15:
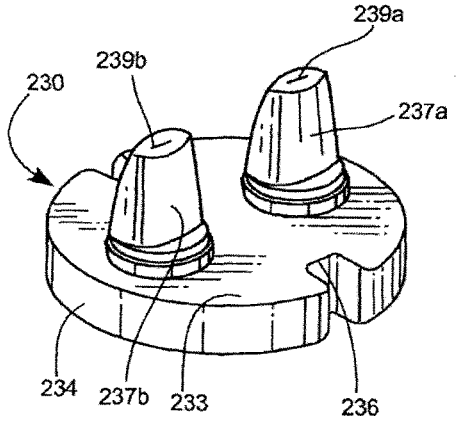
FIG. 15 is a perspective view of an exemplary insert useable with the container of FIG. 13.

With reference to FIGS. 13-15, the exemplary insert 230 in the third embodiment comprises a hollow, cylindrical body portion 232 having two opposed indents 236. Body portion 232 has a top surface or wall 233, an outer flange 234 depending downwardly from the top wall 233, and an inner, generally cylindrical flange 260 depending from the underside of the top wall 233. The inner flange 260 is disposed inwardly from the outer flange 234, and extends downwardly a shorter distance from the top wall 233 of the insert 230 than outer flange 234. The spacing between the inner and outer flanges 260 and 234 is selected so that the upstanding, generally cylindrical neck 215 of the body 212 of the container 200 is received therebetween, as shown in FIG. 14. This provides a more secure fit between container 212 and insert 230.

With reference to FIGS. 14 and 15, the top wall 233 of the insert 230 includes at least first and second exit orifices 238*a* and 238*b*. Valves 237*a* and 237*b* extend upward from the top wall 233 and cover exit orifices 238*a* and 238*b*. In the illustrated form, valves 237*a* and 237*b* can be duck-bill valves. Typically, duck-bill valves 237*a* and 237*b* are made from a rubber or synthetic material. In the illustrated embodiment, valves 237*a* and 237*b* are oriented generally parallel to one another and generally perpendicular to the top wall 233 of insert 230 such that the first and second fluids flow through the valves 237*a* and 237*b* in a direction generally parallel to one another. When the valves 237*a* and 237*b* are in their closed position, illustrated in FIG. 13, the dispensing apertures 239*a* and 239*b* are closed and block the dispensing path of the first and second beverage components. However, when the valves 237*a* and 237*b* are in their open positions, such as when the body 212 of the container 200 is squeezed, the valves 237*a* and 237*b* can open to permit the first and second beverage components to flow through the dispensing apertures 239*a* and 239*b* in the valves 237*a* and 237*b*.

The insert 230 is configured to be inserted partially into the neck 215 of the body 212 of the container 200. In particular, when assembled, as depicted in FIG. 14, the inner flange 260 of the insert 230 is disposed at least partially within the neck 215 of the container 200. After insertion of the insert 230, the cap 220 can be attached to the neck 215 of the body 212 of the container 200.

In the illustrated form, the cap 220 includes a top wall 223, as shown in FIGS. 13 and 14, with a depending skirt 224 about its periphery. In the illustrated form, as shown in FIGS. 13 and 14, valves 137*a* and 137*b* of the insert 230 extend through the top wall 223 and through the first and second dispensing channels or openings in the top wall 223. As shown in FIG. 14, body access openings 258*a* and 258*b* have a greater maximum cross-sectional dimension than the maximum cross sectional dimensions of the valves 237*a* and 237*b*, and of the exit orifices 238*a* and 238*b*, respectively.

When the container 200 is squeezed, such as by depressing opposing portions of the sidewall 216 toward each other, the first and second beverage components stored in the first and second enclosed bodies 211 and 213 are forced out of the first and second body access openings 258*a* and 258*b*, respectively. Upon exiting from the first and second body access openings 258*a* and 258*b*, the first and second liquids follow the first and second dispensing paths, respectively. In particular, the first and second liquids flow into the entrance and out of the exit of exit orifices 238*a* and 238*b* of insert 230. Upon exiting from the exit orifices 238*a* and 238*b*, the first and second fluids then enter the valves 237*a* and 237*b*, flow through the valves 237*a* and 237*b* and exit from the dispensing apertures 239*a* and 239*b*, respectively, in jets.

Figure 12:
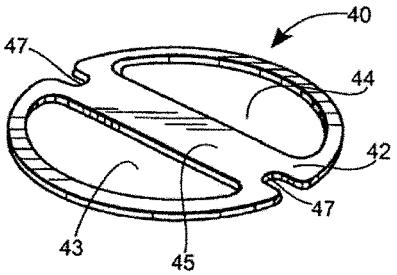
FIG. 12 is a perspective view of an exemplary gasket useable with the containers of FIGS. 1, 9 and 13.

In each of the foregoing embodiments, as shown in FIGS. 7, 8, 10, and 14, a gasket 40 is optionally provided between the necks 15, 115, and 130 of the containers 10, 100, and 200, and the inserts 30, 130, and 230. With reference to FIG. 12, the gasket 40 includes a generally cylindrical body 42 with opposed indents 47 and has a first opening 43 and a second opening 44 separated by a strip or bridge 45. The gasket 40 is shaped to match the shape of the necks 15, 115, 215 of the containers 10, 100, and 200, and the shape of the underside of the inserts 30, 130, and 230. In the illustrated forms, the gasket 40 sits at least in part on the neck of the containers and is at least in part surrounded by the outer flanges 34, 134, 234 of the inserts 30, 130, and 230. The gasket 40 increases the seal between the first and second body access openings 58*a*, 158*a*, 258*a* and 158*b*, 158*b*, 258*b*, and the outer flanges 34, 134, 234 of the inserts 30, 130, and 230.

In the forms illustrated in FIGS. 1-15, the first enclosed body 11, 111, 211 and the second enclosed body 13, 113, and 213 are positioned side-by-side and are identical mirror images of one another. Also, in the forms illustrated in FIGS. 1-15, each exemplary container 10, 200, and 300 is a unitary structure that includes first and second enclosed bodies 11, 111, 211, 13, 113, and 113, respectively. The unitary structure of the exemplary containers 10, 100, and 200 can be formed by blow-molding techniques, or alternatively, by injection molding.

Figure 16:
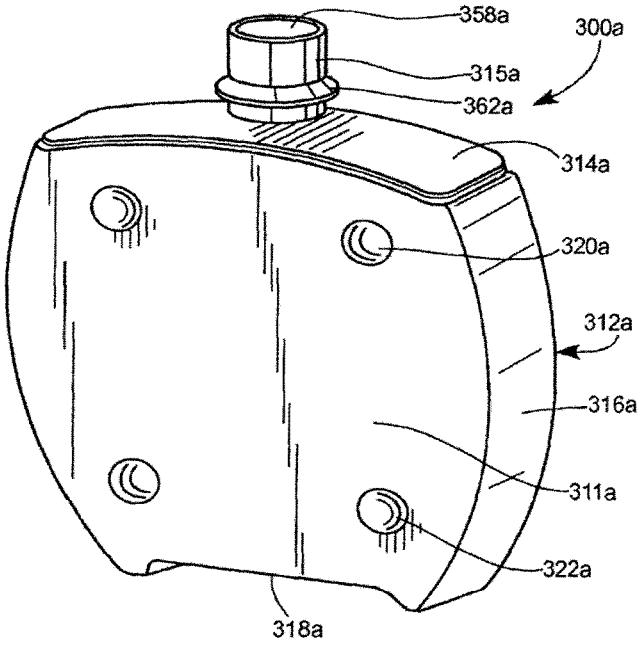
FIG. 16 is a perspective view of an exemplary single compartment body for dispensing beverage concentrates of a fourth embodiment, showing the container body without a cap.
Figure 17:
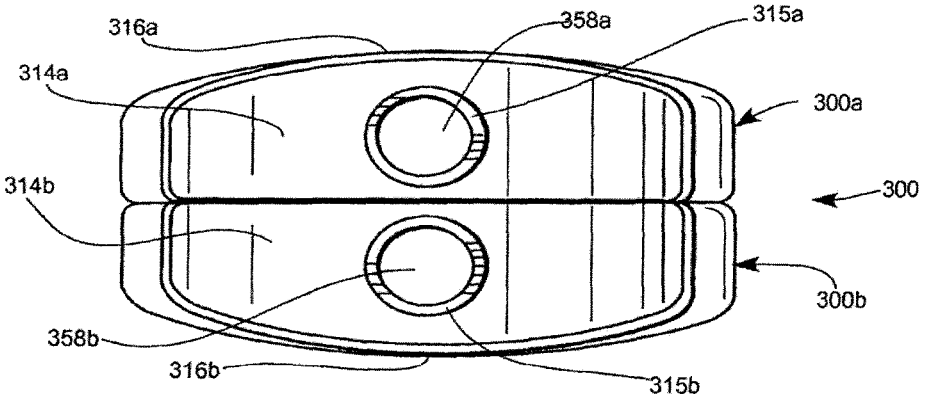
FIG. 17 is a top plan view of an exemplary container body having two compartments assembled from two single compartment bodies of FIG. 16.

With reference to FIGS. 16 and 17, an alternative exemplary form of a container 300 configured for isolating a first and second fluid prior to dispensing and then combining during dispensing is provided. The container 300 is formed by the attachment of two separate first and second enclosed bodies 300*a* and 300*b*.

With reference to FIGS. 16 and 17, the container 300 comprises a first enclosed body 300*a* and a second enclosed body 300*b*. The first and second enclosed bodies 300*a* and 300*b* are preferably, though not necessarily, identical and the description of the structure of the first enclosed body 300*a* equally applies to the structure of the second enclosed body 300*b*.

With reference to FIG. 16, the first enclosed body 300*a* includes an interior enclosed by a bottom wall 318*a*, an opposite shoulder 314*a* at the top portion of the body 300*a*, and a sidewall 316*a* extending between the shoulder 314*a* and the bottom wall 318*a*. A neck 315*a* extends upward from the shoulder 314*a* opposite the bottom wall 318*a* and defines a first body access opening 358*a* that provides an entrance to and an exit from the first enclosed body 300*a*. In the illustrated form, the outer surface of the neck 315*a* of first enclosed body 300*a* includes a downwardly inclined circumferential ramp 362*a*, as illustrated in FIG. 16, for the use in attachment of a cap as described previously and additionally described with reference to FIGS. 19 and 21 below.

With reference to FIG. 17, the second enclosed body 300*b* includes an interior enclosed by a bottom wall (not shown), an opposite shoulder 314*b* at the top portion of the body 300*b*, and a sidewall 316*b* extending between the shoulder 314*b* and the bottom wall. A neck 315*b* extends upward from the shoulder 314*b* opposite the bottom wall and defines a second body access opening 358*b* that provides an entrance to and an exit from the second enclosed body 300*b*. The first and second enclosed bodies 300*a* and 300*b* of container 300 can store the first and second liquids, respectively, separately from one another until the user desires to dispense the first and second liquids.

Sidewall 316*a* of first enclosed body 300*a* includes one or more protuberances 320*a* and one or more recesses 322*a*, while sidewall 316*b* of the second enclosed body 300*b* includes one or more recesses and protuberances (not shown) complementary to protuberances 320*a* and recesses 322*a*, respectively. In the illustrated form, first enclosed body 300*a* and second enclosed body 300*b* are positioned such that one or more protuberances 320*a* of the first enclosed body 300*a* mate with one or more recesses of the second enclosed body 300*b* and vice versa, thereby bringing sidewalls 316*a* and 316*b* into contact and securely retaining first and second enclosed bodies 300*a* and 300*b* to one another to form the exemplary container 300, as shown in FIG. 17. The protuberances 320*a* of first enclosed body 300*a* and the complementary recesses of the second enclosed body 300*b* can alone be sufficient to join the bodies 300*a* and 300*b*. Instead or in addition, adhesives, welding and/or other interlocking structures may be utilized.

The exemplary container 300, like the exemplary containers 10, 100, 200, can be used with any of inserts 30, 130, and 230, and with any of caps 14, 114, 214, and with the gasket 40 described with reference to FIGS. 1-15. For example only, a gasket 40 can be inserted into insert 230, insert 230 can be fitted over the necks 315*a* and 315*b*, and the cap 214 with a lid 226 can be secured to the shoulders 314*a* and 314*b* of the first and second enclosed bodies 300*a* and 300*b* to cover both necks 315*a* and 315*b*. So configured, when the container 300 is squeezed, such as by depressing opposing portions of the sidewalls 316*a* and 316*b* toward each other, the first and second beverage components stored in first and second enclosed bodies 300*a* and 300*b*, respectively, are forced through the valves 237*a* and 237*b* of the insert 230 and exit from the dispensing apertures 238*a* and 238*b* in jets.

Figure 18:
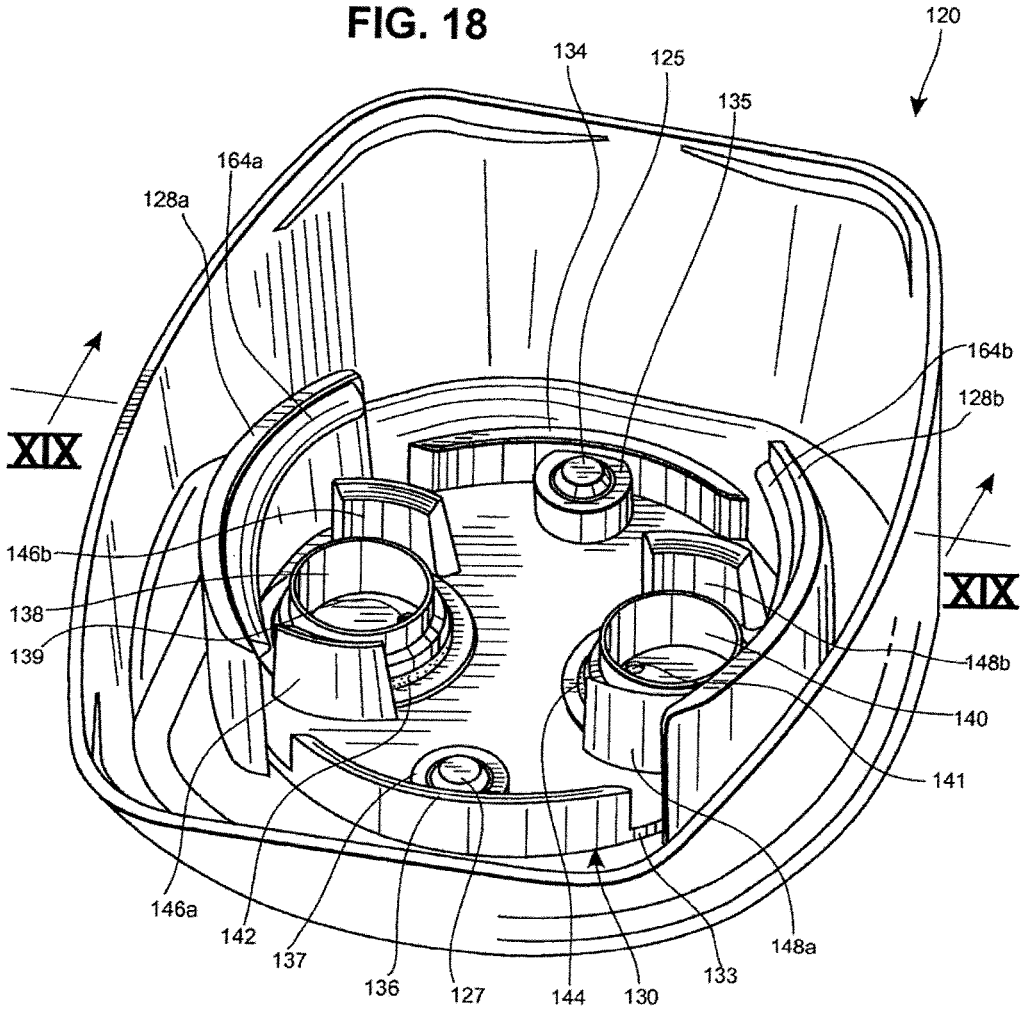
FIG. 18 is a bottom perspective view of an exemplary cap including an insert usable with the container body shown in FIG. 17.
Figure 19:
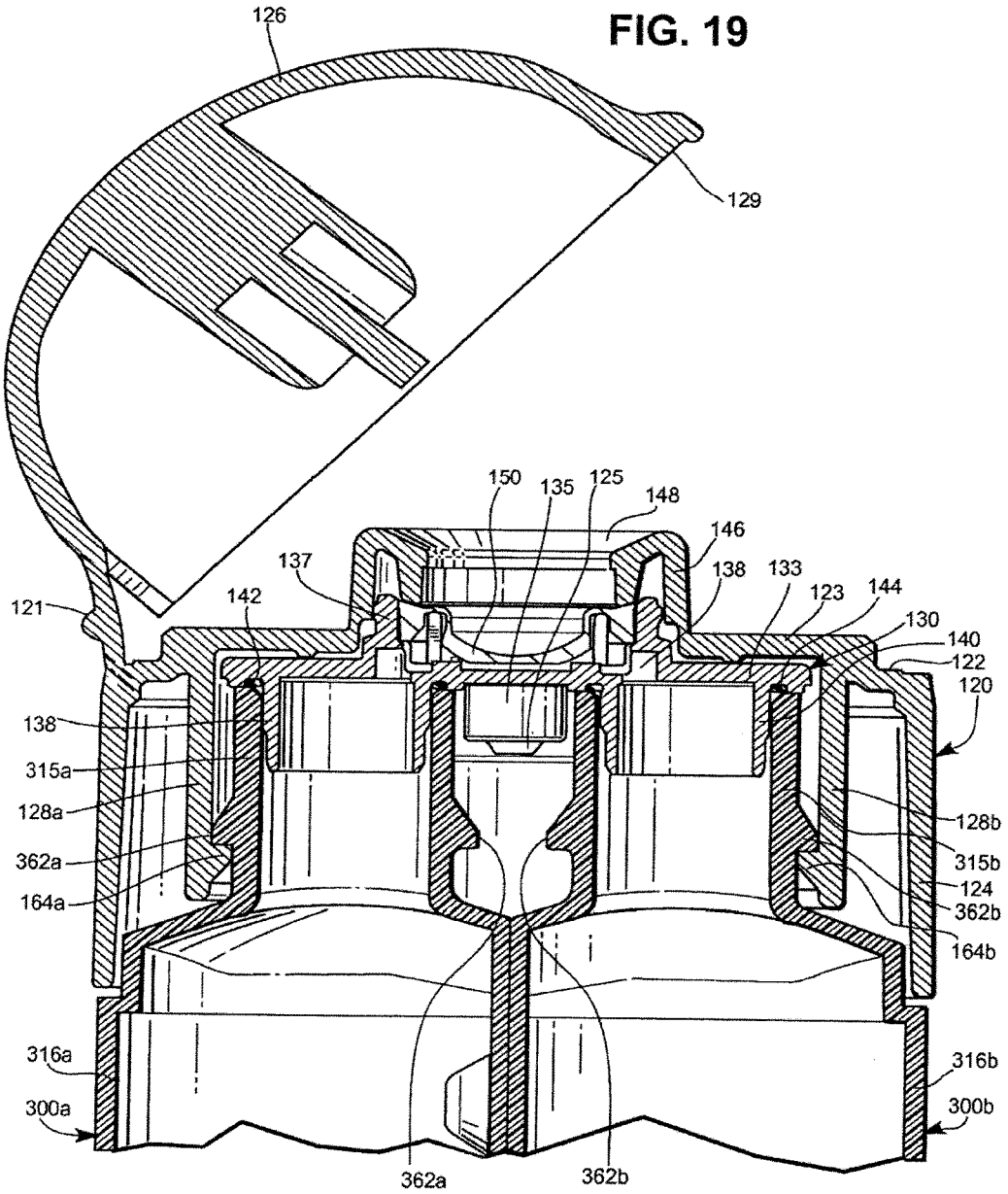
FIG. 19 is a cross-sectional view of the cap and insert of FIG. 18, taken along line XIX of FIG. 18 with the exemplary container body of FIG. 17 being shown along the same cross-sectional view.

With reference to FIG. 18, a cap 120 according to another exemplary form is shown. The cap 120 is configured for use with the containers 300*a* and 300*b* and can be attached to the necks 315*a* and 315*b* of the containers 300*a* and 300*b*, as shown in FIG. 19. Similar to the cap 20 described above, the cap 120 includes a top wall 123 with a depending skirt 124 about its periphery. A raised spout 146 defines an opening 148 extending through the top wall 123. The cap 120 includes a lid 126 moveable between open and closed positions and configured to cover the spout 146 when the lid 126 is in the closed position.

As shown in FIG. 19, the lid 126 is pivotally connected to the remainder of the cap 120 by a hinge 121 and can pivot about the hinge 121 from the open position to the closed position. In one form, the lid 126 can be configured to snap fit with the remainder of the cap 120. In this form, a recessed portion 122 can be provided along the periphery of the top wall 123 of the cap 120. The recessed portion 122 is configured to receive the bottom surface 129 of the lid 126 to form a snap fit. In the illustrated form, the lid 126 is generally dome-shaped, but the lid 126 can be of other suitable shapes.

In the form illustrated in FIG. 18, the cap 120 has two generally arc-shaped flanges 128*a* and 128*b* depending from the underside of the top wall 123. The flanges 128*a* and 128*b* are positioned opposite one another and configured to engage the outer surface of the necks 315*a* and 315*b* of the containers 300*a* and 300*b*, respectively, as described in more detail below.

In particular, as shown in FIGS. 18 and 19, the distal portions of the flanges 128*a* and 128*b* of the cap 120 include inwardly extending ramps 164*a* and 164*b*, respectively. The outer surfaces of the necks 315*a* and 315*b* include downwardly inclined circumferential ramps 362*a* and 362*b*, respectively. The ramps 164*a* and 164*b* of the flanges 128*a* and 128*b* of the cap 120 and the ramps 362*a* and 362*b* of the necks 315*a* and 315*b* of the containers 300*a* and 300*b* are configured such that they can more readily be slid past each other when the cap 120 is pressed downwardly about the necks 315*a* and 315*b* as compared to when removal of the cap 120 from the necks 315*a* and 315*b* is attempted. In this manner, the cap 120 can be attached to and retained on the necks 315*a* and 315*b* and hence each container 300*a* and 300*b*. As discussed above, the use of the term retain does not mean that it is impossible to move from a given position; rather that there is some force that must be overcome in order to do so.

In order to attach the cap 120 to the necks 315*a* and 315*b*, the ramps 164*a* and 164*b* of the flanges 128*a* and 128*b* slide along the ramps 362*a* and 362*b* of the necks 315*a* and 315*b*, with the necks 315*a* and 315*b* and/or the flanges 128*a* and 128*b* of the cap 120 flexing away from each other until the ledges formed adjacent the respective ramps 164*a* and 164*b* and 362*a* and 362*b* interlock with each other as shown in FIG. 19 to restrict removal of the cap 120 from the necks 315*a* and 315*b* of the containers 300*a* and 300*b*.

The cap 120 includes an exemplary insert 130 coupled to the cap 120, as shown in FIGS. 18 and 19. The insert 130 is generally circular and includes a top wall 133. The insert 130 has a pair of opposed generally arcuate flanges 134 and 136 depending downwardly from the top wall 133. Interior facing surfaces of the flanges 134 and 136 include hollow cylindrical projections 135 and 137 configured to permit the pins 125 and 127, which depend downward from the top wall 123 of the cap 120, to pass therethrough in a friction fit to removably couple the insert 130 to the cap 120.

The insert 130 also includes an upwardly projecting annular rim or valve seat 137 circumscribing an exit orifice 138, as depicted in FIG. 19. Received within the exit orifice 138 of the insert 130 is a flexible valve member 150, which is identical to the valve member 50 described above. As shown in FIG. 19, the valve seat 137 is received within the opening 148 of the spout 146.

The insert 130 also includes two generally tubular members 138 and 140 depending from the underside of the top wall 133. The tubular members 138 and 140 are configured to be insertable in a friction fit into the openings 358*a* and 358*b* in the necks 315*a* and 315*b* of the containers 300*a* and 300*b* to couple the insert 130 and the cap 120 to the containers 300*a* and 300*b*, as depicted in FIG. 19.

Sealing rings 142 and 144 are positioned around the tubular members 138 and 140 proximate the base of each of the tubular members 138 and 140, as depicted in FIGS. 18 and 19. The sealing rings 142 and 144 provide for a substantially water-tight connection between the tubular members 138 and 140 and the interior surfaces of the necks 315*a* and 315*b* of the containers 300*a* and 300*b*, respectively. The top wall 133 of the insert 130 includes through holes forming passages 139 and 141 positioned within the circumference of the tubular members 138 and 140, respectively, as shown in FIG. 18. During the dispensing of the contents of the containers 300*a* and 300*b* by a user, the passages 139 and 141 of the insert 130 permit the flow of one or more liquids from the interior of the containers 300*a* and 300*b* as discussed in more detail below.

The insert 130 includes four downwardly extending generally arcuate flanges 146*a*, 146*b*, 148*a* and 148*b*, as illustrated in FIG. 18. The flanges 146*a*, 146*b*, 148*a* and 148*b* extend downwardly a longer distance from the top wall 133 of the insert 130 than the flanges 134 and 136. The flanges 146*a* and 146*b* are located on opposite sides of the tubular member 138 while the flanges 148*a* and 148*b* are positioned on opposite sides of the tubular member 140. It is to be appreciated that the number and position of the flanges 146*a*, 146*b*, 148*a*, and 148*b* has been shown by way of example only and any suitable number of these flanges can be positioned in any suitable arrangement adjacent the tubular members 138 and 140.

The flanges 146*a*, 146*b*, 148*a*, and 148*b* of the insert 130 are sized and shaped to at least partially surround the necks 315*a* and 315*b* of the containers 300*a* and 300*b*. In particular, when the cap 120 and the containers 300*a* and 300*b* are assembled, as shown in FIG. 19, the tubular members 138 and 140 are disposed at least partially in a friction fit within the necks 315*a* and 315*b*, while the flanges 146*a*, 146*b*, 148*a*, and 148*b* are disposed at least partially in a friction fit around the exterior of the necks 315*a* and 315*b*. As such, the necks 315*a* and 315*b* are at least in part retained between the tubular members 138 and 140 and the flanges 146*a*, 146*b*, 148*a*, and 148*b* such that a secure fit is formed between the cap 120, the insert 130, and the containers 300*a* and 300*b*, restricting potential dislodging of the cap 120 from the containers 300*a* and 300*b* during transportation or use by a consumer.

The dispensing or exit path of the first and second beverage components extends from the first and second body access openings 358*a* and 358*b* through the passages 139 and 141 and the exit orifice 138 of the projecting rim 137, and into a region bounded by the bottom of the spout 146, a portion of the valve member 150, and the projecting rim 137, as shown in FIGS. 17-19. The valve member 150 of the insert 130 is identical to the valve member 50 discussed above and is movable between a closed position shown in FIG. 19, blocking the dispensing path of the first and second beverage components, and an open position (not shown) permitting flow of the first and second beverage components through the exit path.

Figure 20:
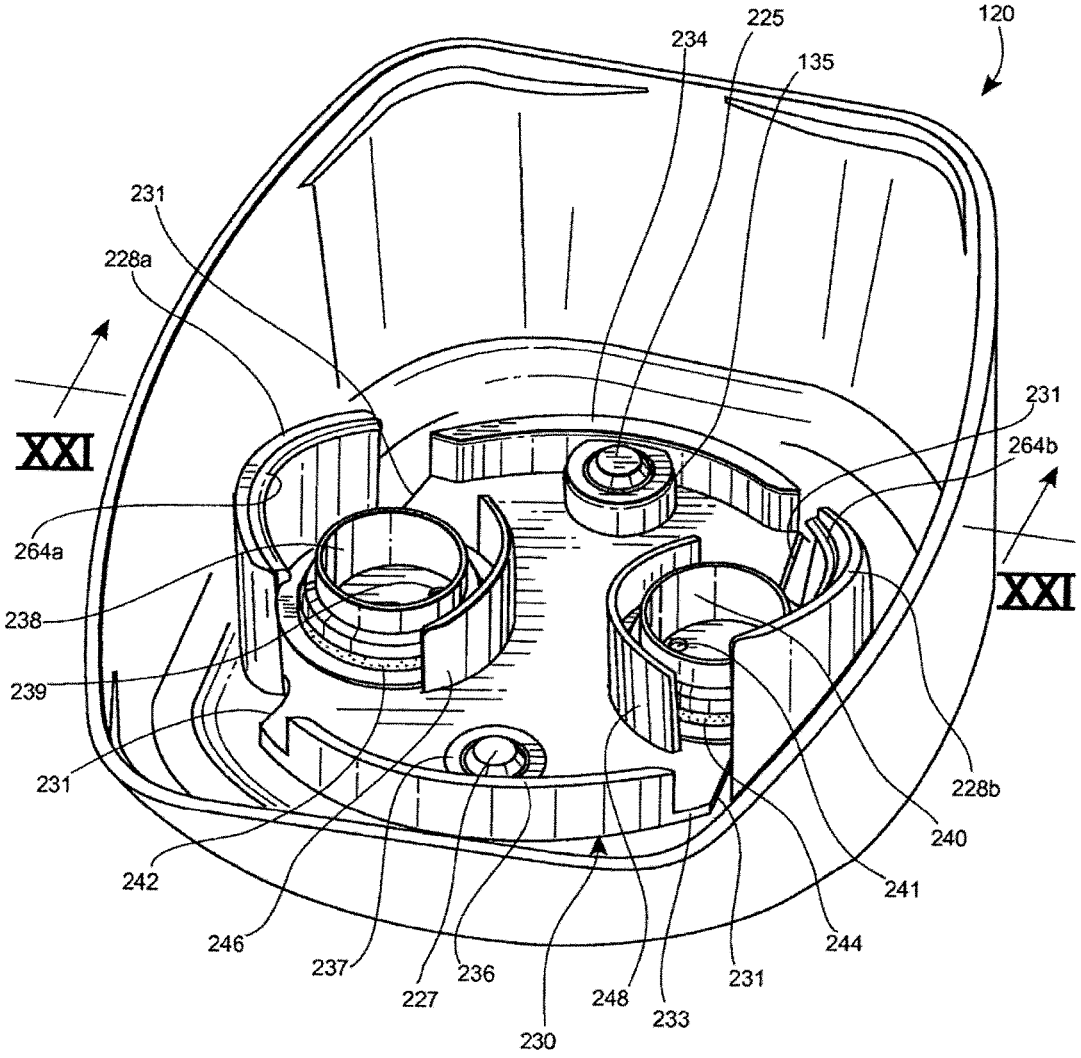
FIG. 20 is a bottom perspective view of another exemplary cap including an insert usable with the container body shown in FIG. 17.
Figure 21:
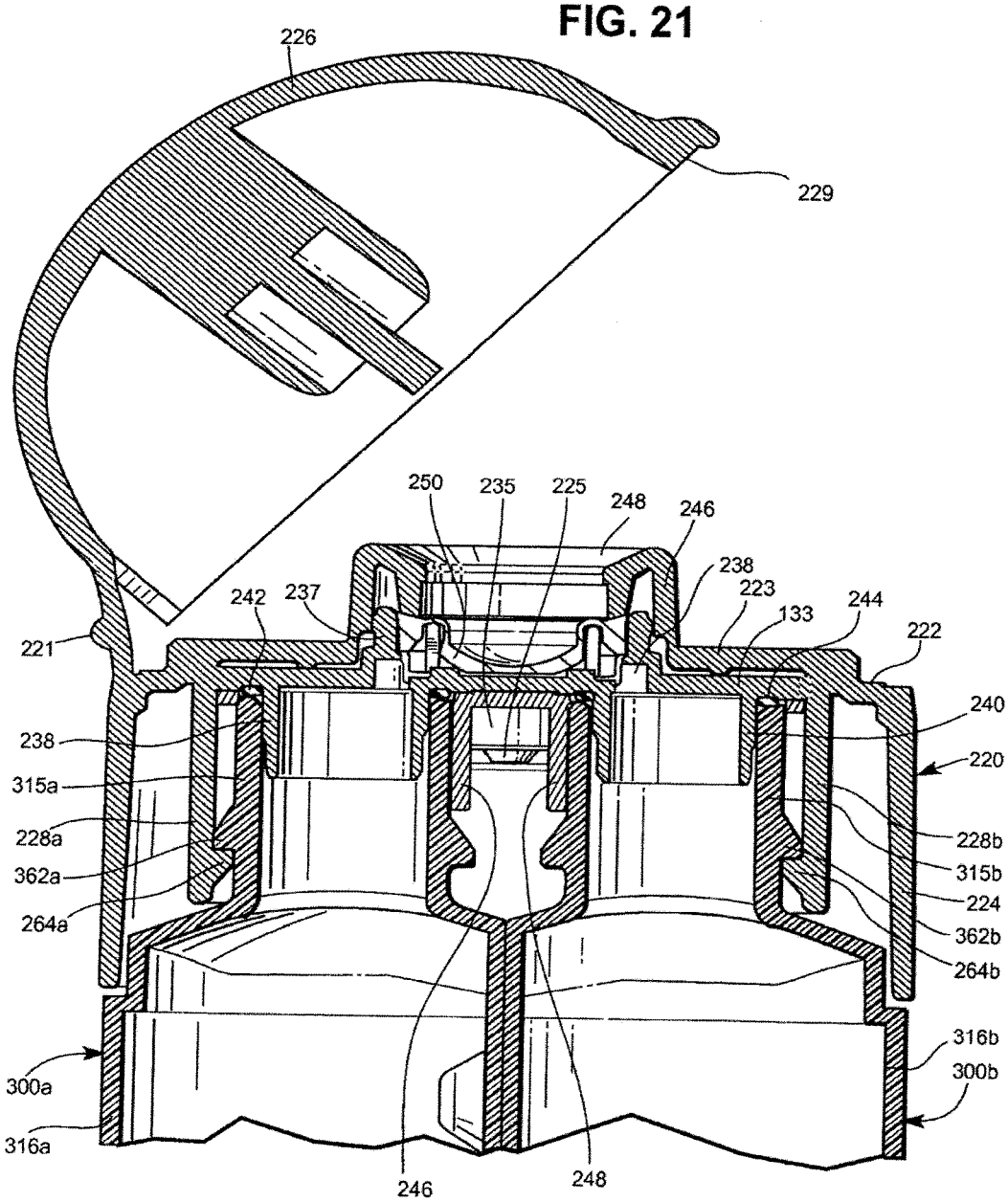
FIG. 21 is a cross-sectional view of the cap and insert of FIG. 20, taken along line XXI of FIG. 20 with the exemplary container body of FIG. 17 being shown along the same cross-sectional view.

A cap 220 according to yet another exemplary embodiment is shown in FIG. 20. Similar to the cap 120, the cap 220 is configured for use with the containers 300*a* and 300*b* and can be attached to the necks 315*a* and 315*b* of the containers 300*a* and 300*b*, as shown in FIG. 21. The cap 220 includes a top wall 223 with a depending skirt 224 about its periphery. A raised spout 246 defines an opening 248 extending through the top wall 223. The cap 220 includes a lid 226 moveable between open and closed positions and configured to cover the spout 246 when the lid 226 is in the closed position. The lid 226 illustrated in FIG. 21 is identical to the lid 126 shown in FIG. 19 and will not be separately discussed.

The cap 220 has two generally arc-shaped flanges 228*a* and 228*b* depending from the underside of the top wall 223, as depicted in FIG. 20. The flanges 228*a* and 228*b* of the cap 220 have a shorter length and a smaller radius of curvature than the flanges 128*a* and 128*b* of the cap 120, as shown in FIGS. 18 and 20. Similar to the flanges 128*a* and 128*b* of the cap 120, the flanges 228*a* and 228*b* of the cap 220 are opposite one another and configured to engage the outer surface of the necks 315*a* and 315*b* of the containers 300*a* and 300*b*, respectively, as described in more detail below.

The distal portions of the flanges 228*a* and 228*b* of the cap 220 include inwardly extending ramps 264*a* and 264*b*, respectively, as illustrated in FIGS. 20 and 21. The outer surfaces of the necks 315*a* and 315*b* include downwardly inclined circumferential ramps 362*a* and 362*b*, respectively. The ramps 264*a* and 264*b* of the flanges 228*a* and 228*b* of the cap 220 and the ramps 362*a* and 362*b* of the necks 315*a* and 315*b* of the containers 300*a* and 300*b* are configured such that they can more readily be slid past each other when the cap 220 is pressed downwardly about the necks 315*a* and 315*b* as compared to when removal of the cap 220 from the necks 315*a* and 315*b* is attempted. In this manner, the cap 220 can be attached to and retained on the necks 315*a* and 315*b* of the containers 300*a* and 300*b*.

In order to attach the cap 220 to the necks 315*a* and 315*b*, the ramps 264*a* and 264*b* of the flanges 228*a* and 228*b* slide along the ramps 362*a* and 362*b* of the necks 315*a* and 315*b*, with the necks 315*a* and 315*b* and/or the flanges 228*a* and 228*b* of the cap 220 flexing away from each other until the ledges formed adjacent the respective ramps 264*a* and 264*b* and 362*a* and 362*b* interlock with each other as shown in FIG. 21 to restrict removal of the cap 220 from the necks 315*a* and 315*b* of the containers 300*a* and 300*b*.

The cap 220 includes an exemplary insert 230 coupled to the cap 220, as shown in FIGS. 20 and 21. The insert 230 is partially circular but includes four recessed portions 231 that allow the insert 230 to be positioned at least partly outside of an area between the arcuate flanges 228*a* and 228*b*. The insert 230 includes a top wall 233 and a pair of opposed generally arcuate flanges 234 and 236 depending downwardly from the top wall 233. In the illustrated form, the interior facing surfaces of the flanges 134 and 136 include hollow cylindrical projections 135 and 137 that permit the pins 225 and 227, which depend downward from the top wall 223 of the cap 220, to pass therethrough in a friction fit to removably couple the insert 230 to the cap 220.

The insert 230 also includes an upwardly projecting annular rim or valve seat 237 circumscribing an exit orifice 238, as depicted in FIG. 21. Received within the exit orifice 238 of the insert 230 is a flexible valve member 250, which is identical to the valve members 50 and 150. The valve seat 237 is received within the opening 248 of the spout 246, as shown in FIG. 21.

Similar to the insert 130, the insert 230 also includes two generally tubular members 238 and 240 depending from the underside of the top wall 233. The tubular members 238 and 240 are configured to be insertable in a friction fit into the openings 358*a* and 358*b* in the necks 315*a* and 315*b* of the containers 300*a* and 300*b* to couple the insert 230 and the cap 220 to the containers 300*a* and 300*b*, as shown in FIG. 21.

The Sealing rings 242 and 244 are positioned around the tubular members 238 and 240 proximate the base of each of the tubular members 238 and 240, as illustrated in FIGS. 20 and 21. The sealing rings 242 and 244 provide for a substantially water-tight connection between the tubular members 238 and 240 and the interior surfaces of the necks 315*a* and 315*b* of the containers 300*a* and 300*b*, respectively. The top wall 233 of the insert 230 includes through holes forming passages 239 and 241 positioned within the circumference of the tubular members 238 and 240, respectively, as shown in FIG. 20. During the dispensing of the contents of the containers 300*a* and 300*b* by a user, the passages 239 and 241 of the insert 230 permit the flow of one or more liquids from the interior of the containers 300*a* and 300*b* as discussed in more detail below.

The insert 230 includes two downwardly extending generally arcuate flanges 246 and 248, as depicted in FIG. 20. The flanges 246 and 248 extend downwardly a longer distance from the top wall 233 of the insert 230 than the flanges 234 and 236. The flanges 246 and 248 are located on opposite sides of the tubular members 238 and 240 relative to the arcuate flanges 228*a* and 228*b* of the cap 220. The flanges 246 and 248 of the cap 220 have a longer length but a smaller radius of curvature than the flanges 146*a*, 146*b*, 148*a*, and 148*b* of the cap 120, as shown in FIGS. 18 and 20. It will be appreciated that the size, number, and position of the flanges 246 and 248 has been shown by way of example only and any suitable number of flanges of suitable sizes can be positioned in any suitable arrangement adjacent the tubular members 238 and 240.

The flanges 246 and 248 of the insert 230 are sized and shaped to at least partially surround the necks 315*a* and 315*b* of the containers 300*a* and 300*b*. In particular, when the cap 220 and the containers 300*a* and 300*b* are assembled as shown in FIG. 21, the tubular members 238 and 240 of the insert 230 are disposed at least partially in a friction fit within the necks 315*a* and 315*b*, while the flanges 228*a* and 228*b* of the cap 220 and the flanges 246 and 248 of the insert 230 are disposed at least partially in a friction fit around the exterior of the necks 315*a* and 315*b*.

The flanges 228*a* and 228*b* of the cap 220 are approximately twice as long as the flanges 246 and 248 of the insert 230 such that the distal ends of the flanges 228*a* and 228*b* extend below the ramps 362*a* and 362*b*, respectively, while the distal ends of the flanges 246 and 248 are positioned above the ramps 362*a* and 362*b*, respectively, as shown in FIG. 21. The necks 315*a* and 315*b* are at least in part retained between the tubular members 238 and 240 and the flanges 228*a*, 228*b*, 246 and 248, such that a secure fit is formed between the cap 220, the insert 230, and the containers 300*a* and 300*b*, restricting potential dislodging of the cap 220 from the containers 300*a* and 300*b* during transportation or use by a consumer.

The dispensing or exit path of the first and second beverage components extends from the first and second body access openings 358*a* and 358*b* through the passages 239 and 241 and the exit orifice 238 of the projecting rim 237, and into a region bounded by the bottom of the spout 246, a portion of the valve member 250, and the projecting rim 237, as depicted in FIGS. 20 and 21. The valve member 250 of the insert 230 is identical to the valve member 50 discussed above and is movable between a closed position shown in FIG. 21, blocking the dispensing path of the first and second beverage components, and an open position (not shown) permitting flow of the first and second beverage components through the exit path.

The foregoing containers described herein may have resilient sidewalls that permit them to be squeezed to dispense the liquid concentrate or other contents. In particular, the body 12 of the container 10 can be resilient. By resilient, what is meant that they return to or at least substantially return to their original configuration when no longer squeezed. Further, the containers may be optionally provided with structural limiters for limiting displacement of the sidewall, i.e., the degree to which the sidewalls can be squeezed. This can advantageously contribute to the consistency of the discharge of contents from the containers.

The drawings and the foregoing descriptions are not intended to represent the only forms of the containers and methods in regards to the details of construction, assembly and operation. Changes in form and in proportion of parts, as well as the substitution of equivalents, are contemplated as circumstances may suggest or render expedient.

The invention claimed is:

1. A container for isolating a first liquid and a second liquid prior to dispensing, the container comprising:

a first enclosed body for containing the first liquid and having a first body access opening;

a second enclosed body for containing the second liquid and having a second body access opening, the second body access opening being adjacent to the first body access opening;

a common cap secured to at least one of the first and second enclosed bodies, the common cap having a first dispensing channel and a second dispensing channel, each of the channels having an open end and an end with a dispensing aperture;

an insert including a top wall and an outer flange depending downwardly from the top wall, the insert being positioned between the access openings of the first and second enclosed bodies and the common cap such that the top wall and the outer flange of the insert are fully enclosed by the common cap, the insert defining a first dispensing path having an upstream entrance in fluid communication with the first body access opening and a downstream exit in fluid communication with the first dispensing channel and a second dispensing path having an upstream entrance in fluid communication with the second body access opening and a downstream exit in fluid communication with the second dispensing channel, each of the respective upstream entrances being offset from the dispensing channels; and a first deflector and a second deflector, each of the first and second deflectors extending upwardly from the top wall and configured to redirect the first and second liquid flowing from the respective downstream exit in a direction toward one another and into the first and second dispensing channels, respectively.

2. The container of claim 1, wherein the first and second dispensing channels have central axes that are closer together than central axes of the first and second body access openings.

3. The container of claim 1, wherein the first and second body access openings each have a maximum cross-sectional area greater than a maximum cross-sectional area of each of the first and second dispensing channels.

4. The container of claim 1, wherein the common cap includes a lid having an open position and a closed position, the lid being configured to cover each of the dispensing apertures when the lid is in the closed position.

5. The container of claim 1, wherein the common cap includes a top wall and a raised spout extending from the top wall, the spout including two dispensing apertures.

6. The container of claim 5, wherein the spout includes a wall separating the first and second dispensing channels.

7. The container of claim 1, wherein the first and second deflector are configured to redirect the first and second liquid flowing from the respective downstream exit in a direction toward the wall separating the first and second dispensing channels.

8. The container of claim 7, wherein each of the first and second deflectors at least in part overlies a respective downstream exit of the first and second dispensing paths.

9. The container of claim 1, further comprising a gasket positioned between the access openings of the first and second enclosed bodies and the insert.

10. The container of claim 1, wherein the first enclosed body and the second enclosed body are positioned side-by-side in the container.

11. The container of claim 1, wherein the first enclosed body and the second enclosed body share a common wall configured to separate the first enclosed body from the second enclosed body.

12. The container of claim 1, wherein the first enclosed body and the second enclosed body are a unitary, blow-molded or injection molded structure.

13. A method of dispensing a first liquid and a second liquid from the container of claim 1, the method comprising:

decreasing an interior volume of the first enclosed body to cause at least some of the first liquid to exit the first enclosed body and be discharged in a first liquid jet through the dispensing aperture of the first dispensing channel; and substantially simultaneously decreasing an interior volume of the second enclosed body to cause at least some of the second liquid to exit the second enclosed body and be discharged in a second liquid jet through the dispensing aperture of the second dispensing channel.

* * * * *